United States Patent [19]

Levand, Jr. et al.

[11] Patent Number: 4,891,554

[45] Date of Patent: Jan. 2, 1990

[54] ARC DISCHARGE LAMP HAVING IMPROVED PERFORMANCE

[75] Inventors: Victor A. Levand, Jr., Lyndhurst; Mark E. Duffy, Shaker Heights, both of Ohio

[73] Assignee: General Electric Company, Schenectady, N.Y.

[21] Appl. No.: 264,477

[22] Filed: Oct. 31, 1988

[51] Int. Cl.[4] ..... H01J 61/30

[52] U.S. Cl. ..... 313/634; 313/623

[58] Field of Search ..... 313/634, 25, 601, 623; 220/2.1 R; 445/22, 26

[56] References Cited

U.S. PATENT DOCUMENTS 4,007,397 2/1977 Lake ..... 315/51
4,056,751 11/1977 Gungle et al. ..... 313/634
4,498,027 2/1985 Kavlotski et al. ..... 313/634
4,581,557 4/1986 Johnson ..... 313/25

*Primary Examiner*—Donald J. Yusko
*Assistant Examiner*—Sandra L. O'Shea
*Attorney, Agent, or Firm*—John P. McMahon; Stanley C. Corwin; Fred Jacob

[57] ABSTRACT

An improved high intensity arc discharge lamp is disclosed having curved projection means included when a bowed shape arc discharge is being closed to preclude molten vitreous material from deforming the internal cavity. In this manner, the arc tube internal cavity is more reliably shaped and sized with the discharge electrodes being more accurately positioned within the internal cavity. Such curved projection means are provided in each pinch seal region of the arc tube and can be formed mechanically with the jaw members ordinarily employed for the pinch sealing operation.

15 Claims, 2 Drawing Sheets

Fig. 1
(PRIOR ART)
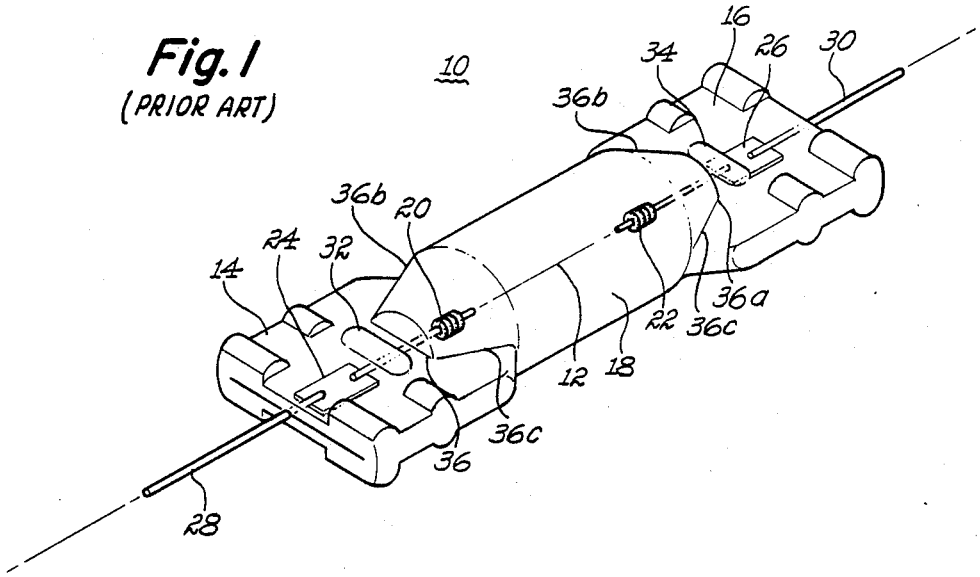
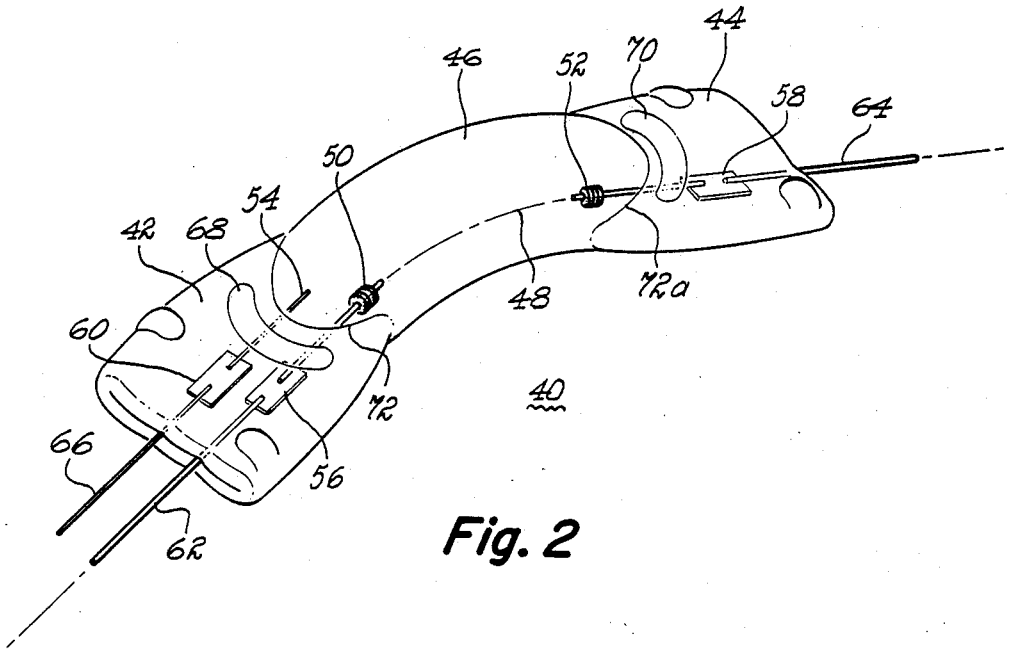
Fig. 2

ARC DISCHARGE LAMP HAVING IMPROVED PERFORMANCE

BACKGROUND OF THE INVENTION

This invention relates generally to an improved arc tube configuration for a high intensity arc discharge lamp and more particularly to providing a means whereby such arc tube can be fabricated without accompanying distortion of the inner arc tube cavity.

High intensity arc discharge lamps generally employ a tubular arc tube of vitreous material as the light source. The arc tube comprises a hermetically sealed envelope, which can be quartz glass, having thermionic electrodes at opposite ends in the pinch seal regions and further contains a gaseous discharge medium which includes mercury. A typical lamp embodiment of this type is disclosed in U.S. Pat. No. 4,007,397, assigned to the assignee of the present invention, wherein the arc tube is physically supported within an outer envelope of light transmissive material by a metal mount frame and with the arc tube further including a starting electrode. The gaseous discharge medium therein disclosed can further contain alkaki metal or alkaline earth metal additives to form an amalgam with mercury. In more recently issued U.S. Pat. No. 4,581,557, also assigned to the present assignee, there is disclosed a mercury amalgam disposed within the arc tube of a high intensity arc discharge lamp so as to stabilize the electrical power being supplied to the lamp against variations in line voltage. The desired mercury amalgam is said to be formed with metals selected from the group consisting of copper, zinc, cadmium, gallium, indium, thallium, antimony and silver including combinations thereof. Both of said commonly assigned patents are specifically incorporated herein by reference since the present improvement can be applied to both type prior art lamp constructions.

Conventional fabrication of an arc tube in such type lamp constructions proceeds with a length of the light transmissive vitreous tubing having discharge electrodes centrally positioned at each end. The discharge electrodes are hermetically sealed within the central cavity formed in the vitreous tubing length by a heat sealing operation conducted at both tubing ends and wherein the molten vitreous material is pinched together mechanically with a cooperating set of jaw members. Such conventional pinch sealing operation is understandably conducted at sufficiently elevated temperatures to melt the vitreous material and form the internal cavity of the arc tube between the oppositely disposed pinch seal ends while further hermetically sealing the discharge electrodes within this cavity. A suitable gaseous discharge medium, as above indicated, is thereafter provided in the arc tube which can be supplied through separate exhaust tube means in the already known manufacturing procedures for this type lamp. A typical arc tube configuration fabricated in this manner can have the physical shape disclosed in both previously referenced patents with such arc tube construction comprising an elongated cylindrical shape aligned along a central or longitudinal linear axis. Another known arc tube configuration employs an elongated cylinder aligned along an arcuate curvilinear axis so as to provide a bowed shape member. Both type arc tube configuration desirably have the oppositely disposed principal discharge electrodes aligned along the longitudinal axis of the arc tube.

Several problems still exist with conventional lamp manufacture in the foregoing manner which can deleteriously effect optimum and reliable lamp performance. All of these problems relate to an objectionable flow of vitreous material when the arc tube cavity or chamber is formed by pinch or press sealing means. More particularly, both the shape and volume of the arc tube cavity can be significantly distorted or altered with an overflow of the vitreous material and to a degree which disturbs the lamp performance. For example, a variation in the arc tube volume alters the dosage for the gaseous discharge medium which in turn can influence the operating voltage for this type lamp. A distortion in the ends of the arc tube chamber produces other undesirable effects upon the lamp performance. First of all, significant distortion at the chamber ends can reduce control of the lamp operating voltage as well as reduce control of the lamp operating temperature. Since lamp temperature dictates efficacy and color provided with the illumination, it can be appreciated that end chamber distortion reduces control of important factors in the lamp operation. Proper temperature control at the arc chamber ends is important in regulating condensation of the solid components in the gaseous discharge medium during the lamp operation. It follows from such considerations that both arc tube chamber size and shape must be carefully controlled in providing reliable and optimum lamp performance. Still other important considerations apply for proper construction of the arc tube member itself. For example, any significant distortion of the arc tube cavity during the pinch sealing can compromise a desired positioning of the discharge electrodes. The mechanical strength of the arc tube would also be influenced by distortion of the internal cavity.

Accordingly, one object of the present invention is to provide improved means whereby greater control is exercised over the physical configuration of a particular arc tube member being employed in a high intensity arc discharge lamp.

Another object of the invention is to provide an improved arc tube construction which includes physical means better avoiding distortion during the arc tube fabrication.

A still further object of the invention is to provide a high intensity arc discharge lamp employing specific arc tube means.

Still another object of the present invention is to provide a relatively simple modification in otherwise conventional lamp manufacture enabling improved construction of a particular lamp arc tube member.

These and still further objects of the present invention will become apparent upon considering the following detailed description for the present invention.

SUMMARY OF THE INVENTION

A novel arc tube member is now provided for a high intensity arc discharge lamp ameliorating all of the foregoing problems encountered during the arc tube fabrication. In general, such improved arc tube member now includes projection means formed with accumulated vitreous material when the pinch seals are formed. More particularly, such improvement is provided in an arc tube member having a bowed or curved physical contour with curved ends being provided in a central cavity formed by the pinch seal means and which now further includes curved projections having substantially the same contour as the curved central cavity ends.

In another additional form of the present invention, a representative high intensity arc discharge lamp comprises (a) an outer light transmissive vitreous envelope having a screw base member affixed thereto which includes terminal means electrically connected to a pair of first inlead conductors, (b) an arc tube of vitreous light transmissive material having a bowed physical contour being sealed within the outer envelope and physically suspended therein by a metal mount frame electrically insulated from the first inlead conductors, (c) the arc tube further including a central cavity formed with closed curved ends and having discharge electrodes to include a starter electrode being sealed at the opposite curved cavity ends in pinch seal regions, the discharge and starter electrodes each further being electrically connected to second inlead conductors extending outwardly from the arc tube and being electrically connected to the first inlead conductors, with the arc tube further containing a gaseous discharge medium which includes mercury amalgam, and (d) the arc tube further having curved projection means located in each pinch seal region adjacent to the internal cavity and which are formed with accumulated molten vitreous material when the pinch seals are formed. The arc tube member for the illustrated lamp embodiment has an elongated tubular construction with the curved projection means preferably extending longitudinally in a direction substantially transverse to the curvilinear axis of the arc tube member. A construction of the arc tube member with quartz glass further entails interconnection between all electrode components and inner lead-in conductors to be provided with refractory metal foil elements as disclosed in the prior art patents specifically incorporated herein. Accordingly, both discharge and starter electrodes are interconnected in the press seal regions of the arc tube member to the inlead conductors with thin refractory metal foil elements and with the curved projection means being disposed in both press seal regions preferably inward of such interconnection locations.

BRIEF DESCRIPTION OF THE DRAWINGS

FIG. 1 is a perspective view depicting an arc tube member employed in a prior art high intensity arc discharge lamp.

FIG. 2 is a perspective view depicting a representative arc tube member according to the present invention.

DETAILED DESCRIPTION OF THE PREFERRED EMBODIMENTS

Figure 3:
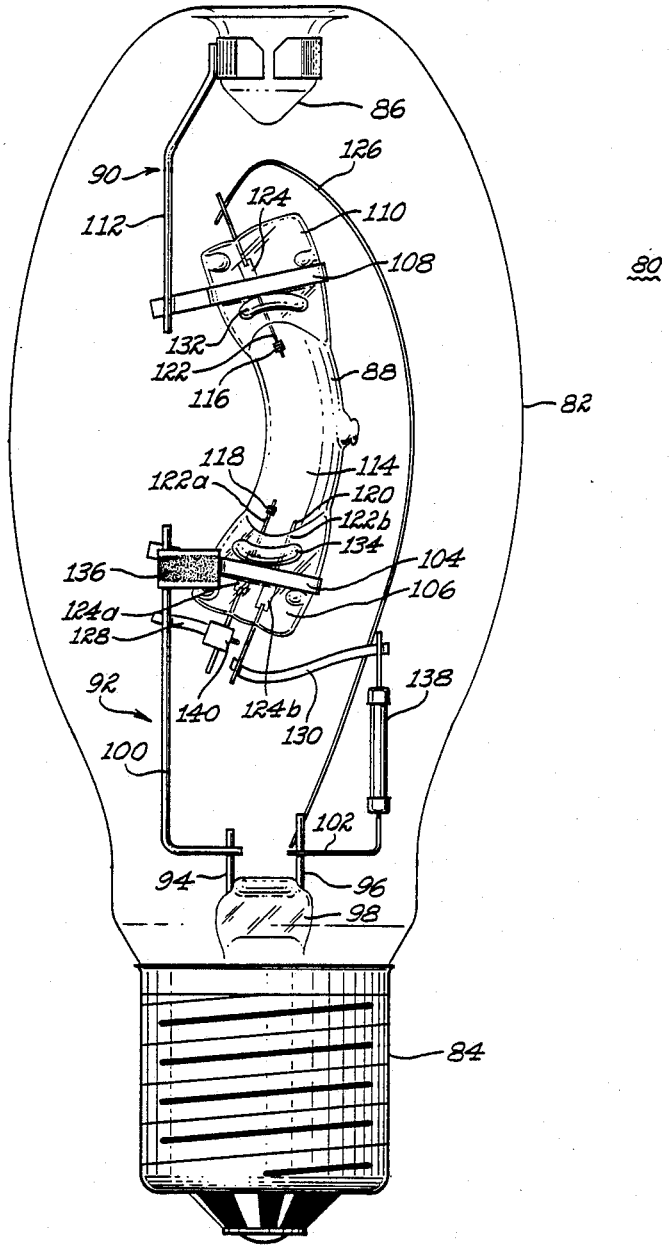
FIG. 3 is a front view for a high intensity arc discharge lamp embodying the arc tube member disclosed in FIG. 2.

Referring to the drawings, there is depicted in FIG. 1 a prior art arc tube member 10 having a cylindrical shape aligned along a central axis 12 with pinch seal regions 14 and 16 enclosing a central cavity 18. A pair of discharge electrodes 20 and 22 are centrally disposed at opposite ends of the arc tube cavity 18 so as to reside substantially coaxial with the lamp longitudinal axis 12. Conventional electrical connection for both discharge electrodes 20 and 22 is made in the respective pinch seal regions by means of interconnection to thin refractory metal foil elements 24 and 26, respectively, which in turn are connected to respective inner lead-in conductors 28 and 30. There is further included in each pinch seal region 14 and 16, paired relief projections 32 and 34, respectively, to avert distortion at the bottom straight ends 36 and **36*a* of the arc tube cavity when the pinch seals are initially formed. The depicted relief projections 32 and 34 are formed during the pinch seal operation with cavities being provided at a proper location in both cooperating pinch sealing jaw members and which become filled with molten quartz otherwise flowing to the cavity opening. As can be seen in the drawing, however, both prior art relief projections extend linearly in a direction following the bottom flat ends 36 and 36*a* of the arc tube cavity but do not further extend in a manner encompassing the angular sides 36*b* and 36*c*** intersecting the flat ends. Accordingly, such limited projections cannot obstruct all molten vitreous material from distorting the cavity ends.

There is depicted in FIG. 2 an arc tube construction 40 according to the present invention which can be suitably employed in a high intensity arc discharge lamp. Accordingly, arc tube member 40 includes end pinch seal regions 42 and 44 to hermetically seal a central cavity portion 46. Central cavity 46 has an arcuate configuration centrally disposed about an arcuate longitudinal axis 48 which further includes curved ends 72 and **72*a*. Centrally disposed along said arcuate longitudinal axis 48 are a pair of discharge electrodes 50 and 52 with a further starting electrode 54 being positioned offset with respect to this axis. All electrodes 50, 52 and 54 are again electrically connected in the respective pinch seal regions to individual thin refractory metal foil elements 56, 58 and 60, respectively, which in turn are further interconnected to respective inner lead-in conductors 62, 64 and 66. Curved relief projections 68 and 70 are provided in the respective pinch seal regions 42 and 44 to accommodate excess molten material flow when the pinch seals are being formed. As distinct from the hereinabove disclosed prior art linear relief projections, however, the herein illustrated curved projections employ an arcuate configuration having substantially the same contour as the curved cavity ends 72 and 72*a* while further extending substantially coextensive therewith so as to encompass both cavity ends. It can be seen, therefore, that such paired relief projections provide a more effective obstruction to excess molten vitreous material being squeezed into the cavity opening and thereby causing its distortion. Such relief projections 68 and 70 can also be seen to be desirably located intermediate the interconnection of the discharge electrodes to the inner lead-in conductors and the curved ends 72 and 72*a* of the central cavity 46** while further having a curved central axis substantially transverse to the arcuate central axis of the arc tube member.

The present arc tube member further includes a gaseous discharge medium (not shown) of the type disclosed in the prior art U.S. Pat. Nos. 4,007,397 and 4,581,557 patents specifically incorporated herein by reference. A suitable gaseous discharge medium can thereby comprise a mixture of a rare gas such as argon, krypton or the like and mercury or rare gas along with mercury and various other metal substances including a vaporizable metal halide compound. Such metal vapor lamps can include alkali metal or alkaline earth metal additives in the gaseous discharge medium along with still other metal substances forming a mercury amalgam to include metals selected from the group consisting of copper, zinc, cadmium, gallium,indium, thallium, silver, antimony and combinations thereof. Other metal additives can also be contained within the arc tube cavity for different purposes including thorium additives for electrode activation and known gettering agents.

FIG. 3 is a front view depicting a representative high intensity arc discharge lamp 80 employing the arc tube member described above in FIG. 2. More particularly, a metal halide type lamp is depicted having a 400 watt size rating and which is also adapted for horizontal operation. The lamp 80 comprises an outer vitreous envelope 82 secured to a screw type conductive base member 84 at one end while further having a dimpled anchoring means 86 disposed at the opposite end. An arc tube 88 having the FIG. 2 construction is physically suspended within the outer envelope 82 by means of a two-part metal mount frame, 90 and 92, which is electrically connected in part to lamp terminal means provided in base member 84. In said regard, said electrical connection is provided with first inlead conductors 94 and 96 extending outward from a conventional reentrant stem 98 to a pair of metal support rods or posts 100 and 102 forming the lower half 92 of the mount frame. Upper half 90 in said mount frame remains electrically isolated or insulated from the lamp terminal means other than when connected thereto during lamp operation by means of the arc discharge (not shown). Lower mount frame member 92 includes a clamp 104 secured to bottom pinch seal region 106 of the arc tube 88 while a similar clamp 108 is provided in the upper frame member 90 and secured to upper pinch seal region 110 of the arc tube as the structural means for its physical support. Such physical support of the arc tube 88 is completed by attaching metal arm 112 in the upper frame member 90 to the dimpled end 86 of the outer vitreous envelope 82. Arc tube member 88 includes an arcuate shaped central cavity 114 containing spaced apart principal discharge wire-electrodes 116 and 118 and a starting wire electrode 120 along with a suitable gaseous discharge medimum including mercury amalgam and a metal halide (not shown), all as previously above described. Also as previously described, all wire electrodes 116, 118 and 120 are individually connected to second lead-in conductors 122, **122*a* and 122*b* in the respective pinch seal regions of the arc tube which are in turn connected to thin refractory metal foil elements 124, 124*a* and 124*b* additionally located thereat. Still further electrical interconnection between the second lead-in conductors 122, 122*a* and 122*b* and the first lead-in conductors 94 and 96 is provided in the illustrated lamp embodiment. Lead-in conductor 122 is connected to lead-in conductor 96 with curved wire element 126 whereas remaining leadin conductors 122*a* and 122*b* are separately connected to lead-in conductors 94 and 96, respectively with conductive metal strips (128 and 130) affixed to the metal support rods 100 and 102 also secured to the latter leadin conductors. In accordance with the present invention, arc tube member 88 still further includes curved projection means 132 and 134 provided in the respective pinch seal regions 106 and 110 when the pinch seals are initially formed in the otherwise customary manner. Each projection means is in the form of oppositely disposed longitudinally extending curved relief projections located on both major planar surfaces of an individual pinch seal region adjacent to the cavity opening 114**. As can also be seen in the drawing, both paired relief projections include a curved central axis which lies substantially transverse to the arcuate curvilinear axis for the arc tube member.

Basic operation of the illustrated lamp embodiment proceeds as already disclosed in the prior art U.S. Pat. Nos. 4,007,397 and 4,581,557 patents previously incorporated herein by reference. As therein disclosed, such type lamp is operated with external ballast means which can still further include incorporating some of the operating circuitry along with still other type optional operating components within the outer envelop of the lamp construction. For example, the presently depicted lamp embodiment includes gettering means 136 provided in the outer envelope 82 to remove gases such as oxygen from undesirably oxidizing the inner lamp components. Additionally, there is included conventional starting resistor means 138 within the outer envelope which forms a part of said lamp operating circuitry. The lamp is enabled by such operating circuit means to ionize vapor formed with the selected gaseous discharge medium in order to produce an arc discharge between the electrodes 116 and 118 providing the output illumination. Initial ionization in the lamp occurs between starting electrode 120 and principal electrode 118 with a bimetallic switch element 140 operating to terminate energization of the starting electrode when an arc discharge is established between the principal discharge electrodes. A significant improvement in the lamp is experienced with the herein disclosed arc tube modification. Successful test results signify more uniform lamp operation to be achievable. Additionally, increased structural burst strength for the present arc tube has been found and to a degree often exceeding test capability of the equipment employed for such measurement.

It will be apparent from the foregoing description that a generally improved means has been provided to minimize distortion in a bowed shape arc tube member adapted for use in a high intensity arc discharge lamp. It is contemplated that modifications can be made in lamp configurations herein illustrated, however, without departing from the spirit and scope of the present invention. For example, these lamps may employ other already known basing constructions, arc tube support means, lamp outer envelope shapes and sizes, specialized ballasting circuits and still other lamp variations. Consequently, it is intended to limit the present invention only by the scope of the appended claims.

What we claim as new and desire to secure by Letters Patent of the United States is:

1. A high intensity arc discharge lamp comprising:

(a) an outer light transmissive envelope having a base member affixed thereto which includes terminal means electrically connected to first inlead conductors, (b) a bowed shape arc tube of vitreous light transmissive material which includes a central cavity having curved ends, said arc tube being sealed within the outer envelope and having discharge electrodes sealed at opposite ends of the central cavity in pinch seal regions, the discharge electrodes further being electrically connected to second inlead conductors extending outwardly from the arc tube and being electrically connected to the first inlead conductors, with the arc tube further containing a gaseous discharge medium which includes mercury, and (c) the arc tube further having curved projection means located in each pinch seal region adjacent to the central cavity with each having substantially the same contour as the curved central cavity ends and which are formed when the pinch seals are provided.

2. The lamp of claim 1 wherein each curved projection means has a central curved axis substantially transverse to the arcuate curvilinear axis of the arc tube.

3. The lamp of claim 1 wherein the curved projection means extend upwardly from opposite planar surfaces in the press seal region.

4. The lamp of claim 3 wherein the pinch seal regions are mechanically formed at elevated temperatures with cooperating jaw members which include recessed cavities forming the projections.

5. The lamp of claim 1 wherein the arc tube is quartz glass.

6. The lamp of claim 5 wherein the discharge electrodes are interconnected in the press seal regions to the second inlead conductors with thin refractory metal foil elements.

7. The lamp of claim 6 wherein the projection means are disposed inwardly of the interconnection locations.

8. The lamp of claim 1 wherein the discharge electrodes further include a starting electrode.

9. The lamp of claim 1 wherein the gaseous discharge member includes a mercury amalgam formed with a metal selected from the group consisting of alkali metals and alkaline earth metals.

10. The lamp of claim 1 wherein the gaseous discharge medium includes a mercury amalgam formed with a metal selected from the group consisting of copper, zinc, cadmium, gallium, indium, thallium, silver, antimony and combinations thereof.

11. A high intensity arc discharge lamp comprising:

(a) an outer light transmissive vitreous envelope having a screw base member affixed thereto which includes terminal means electrically connected to a pair of first inlead conductors, (b) a bowed shape arc tube of vitreous light transmissive material having a central cavity with curved ends, said arc tube being sealed within the outer envelope and physically suspended therein by a metal mount frame electrically connected to the first inlead conductors, (c) the arc tube having discharge electrodes to include a starter electrode being sealed at the opposite ends of the central cavity in pinch seal regions, the discharge and starter electrodes each further being electrically connected to second inlead conductors extending outwardly from the arc tube and being electrically connected to the first inlead conductors, with the arc tube further containing a gaseous discharge medium which includes mercury amalgam, and (d) the arc tube further having curved projection means located in each pinch seal region adjacent to the central cavity which have substantially the same contour as the curved central cavity ends while further extending substantially coextensive therewith and which are formed when the pinch seals are provided.

12. The lamp of claim 11 wherein each curved projection means has a central axis substantially transverse to the arcuate curvilinear axis of the arc tube.

13. The lamp of claim 11 wherein the arc tube is quartz glass.

14. The lamp of claim 13 wherein the discharge and starter electrodes are interconnected in the press seal regions to second inlead conductors with thin refractory metal foil elements.

15. The lamp of claim 14 wherein curved projection means are disposed inwardly of the interconnection locations.

* * * * *